United States Patent [19]

Trace et al.

[11] Patent Number: 5,063,287

[45] Date of Patent: Nov. 5, 1991

[54] PROCESSING CIRCUIT FOR OPTICAL COMBUSTION MONITOR

[75] Inventors: Adrian L. Trace, Solihull, Great Britain; Mark J. Basten, Halesowen, England

[73] Assignee: Lucas Industries, Birmingham, England

[21] Appl. No.: 530,921

[22] Filed: May 30, 1990

[30] Foreign Application Priority Data

May 31, 1989 [GB] United Kingdom ..... 8912462

[51] Int. Cl.[5] ..... H01J 40/14

[52] U.S. Cl. ..... 250/214 AG; 330/279; 330/282

[58] Field of Search ..... 250/214 R, 214 AG; 73/116; 307/311; 330/129, 138, 279, 280, 282

[56] References Cited

U.S. PATENT DOCUMENTS

| | | | |
|---|---|---|---|
| 3,708,678 | 1/1973 | Kreda | 250/214 R |
| 3,743,837 | 7/1973 | Pooley et al. | 250/214 R |
| 3,978,720 | 9/1976 | Ford | 73/116 |
| 4,312,043 | 1/1982 | Frank et al. | 73/116 |
| 4,381,748 | 5/1983 | Eckert et al. | 73/116 |
| 4,459,475 | 7/1984 | Flint et al. | 250/214 AG |
| 4,870,369 | 9/1989 | Bartenstein et al. | 330/282 |
| 4,947,133 | 8/1990 | Thomas | 330/279 |

*Primary Examiner*—David C. Nelms
*Assistant Examiner*—S. Allen
*Attorney, Agent, or Firm*—Abelman Frayne & Schwab

[57] ABSTRACT

A processing circuit is provided for use in an optical combustion monitor for an internal combustion engine. The circuit includes a variable gain amplifier for amplifying a signal from one or more opto-electric transducers sensitive to combustion light in the engine cylinders. A gain control circuit including a peak detector controls the variable gain amplifier so that the peak amplitude of the amplifier output signal is substantially constant.

5 Claims, 4 Drawing Sheets

PROCESSING CIRCUIT FOR OPTICAL COMBUSTION MONITOR

The present invention relates to a processing circuit for an optical combustion monitor.

EP 0 282 295 discloses an arrangement for monitoring combustion in an internal combustion engine, particularly to allow the start and end of combustion to be determined. Two optical transducers with spaced spectral responses observe combustion within an engine cylinder. The transducer output signals are amplified and their ratio is formed so as to allow the start of combustion to be determined.

U.S. No. 4 381 748 also discloses an optical combustion monitoring arrangement in which the output from an optical transducer is differentiated and the differential is compared with a fixed reference value to determine the start of combustion. However, variations in the transducer signal can result in the differential not reaching the reference value so that the arrangement fails to detect the start of combustion.

According to the present invention, there is provided a processing circuit for an optical combustion monitor, comprising a variable gain circuit for receiving an input signal from an optical transducer and means for controlling the gain of the variable gain circuit so as to maintain substantially constant the peak amplitude of output signals from the variable gain circuit.

Preferably, the gain controlling means includes a peak detector for receiving the variable gain circuit output signals. The peak detector preferably has a decay time constant such that the detector output decays to substantially 95% of the peak value thereof during the longest expected period between peaks of the input signal. Preferably, the gain controlling means includes a differencing circuit for forming the difference between the detector output and a reference value.

Preferably the variable gain circuit comprises an amplifier with a negative feedback circuit including a voltage dependent resistor, such as a field effect transistor.

The invention will be further described, by way of example, with reference to the accompanying drawings, in which.

Figure 1:
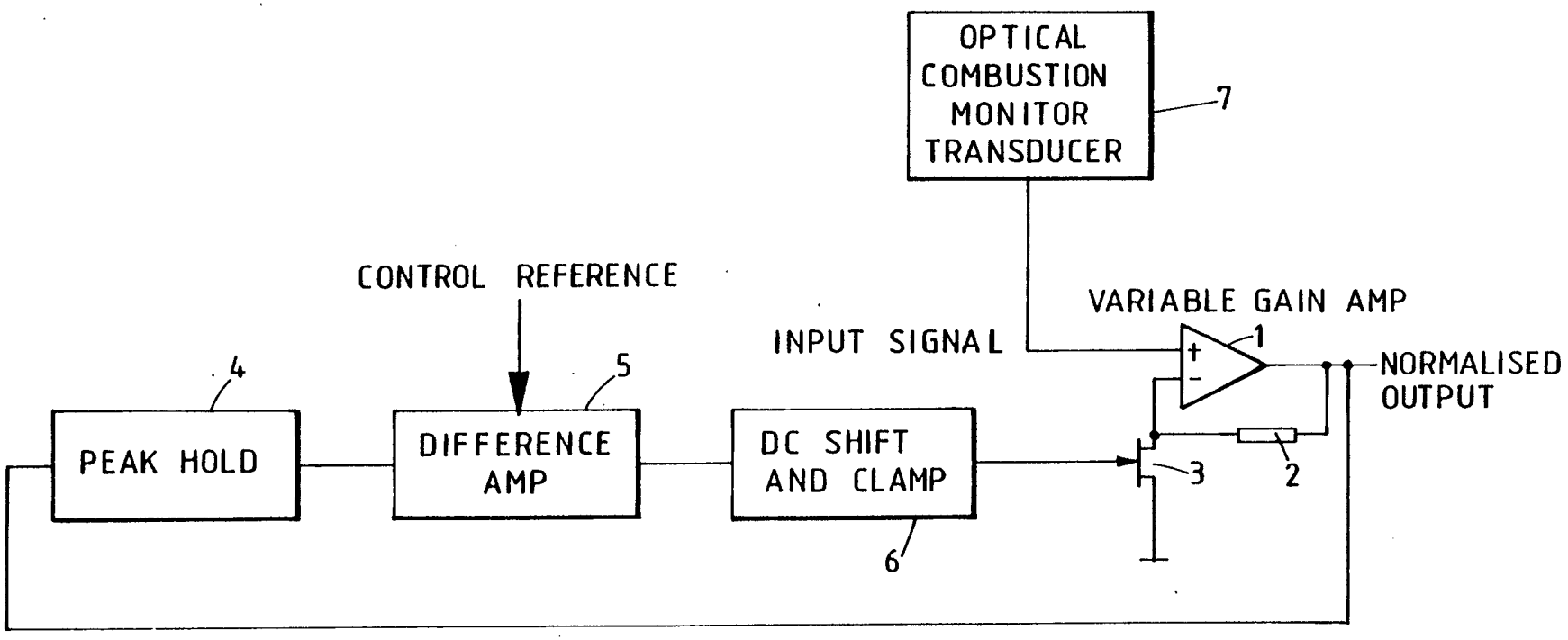
FIG. 1 is a block schematic diagram of an optical combustion monitor processing circuit constituting a preferred embodiment of the invention.

The processing circuit shown in FIG. 1 comprises a variable gain amplifier formed by an operational amplifier 1 and a negative feedback network comprising a resistor 2 and a junction field effect transistor 3. An input signal is supplied from an optical combustion monitor transducer 7 to the non-inverting input of the amplifier 1, whose output provides a normalised output signal.

The output of the amplifier 1 is connected to the input of a peak hold or peak detector circuit 4. A differencing amplifier 5 forms the difference between the output of the peak hold circuit 4 and a control reference. The output of the amplifier 5 is supplied to a DC shift and clamp circuit 6, whose output is applied to the gate of the field effect transistor 3 so as to vary the channel resistance thereof and hence vary the gain of the variable gain amplifier.

Figure 2:
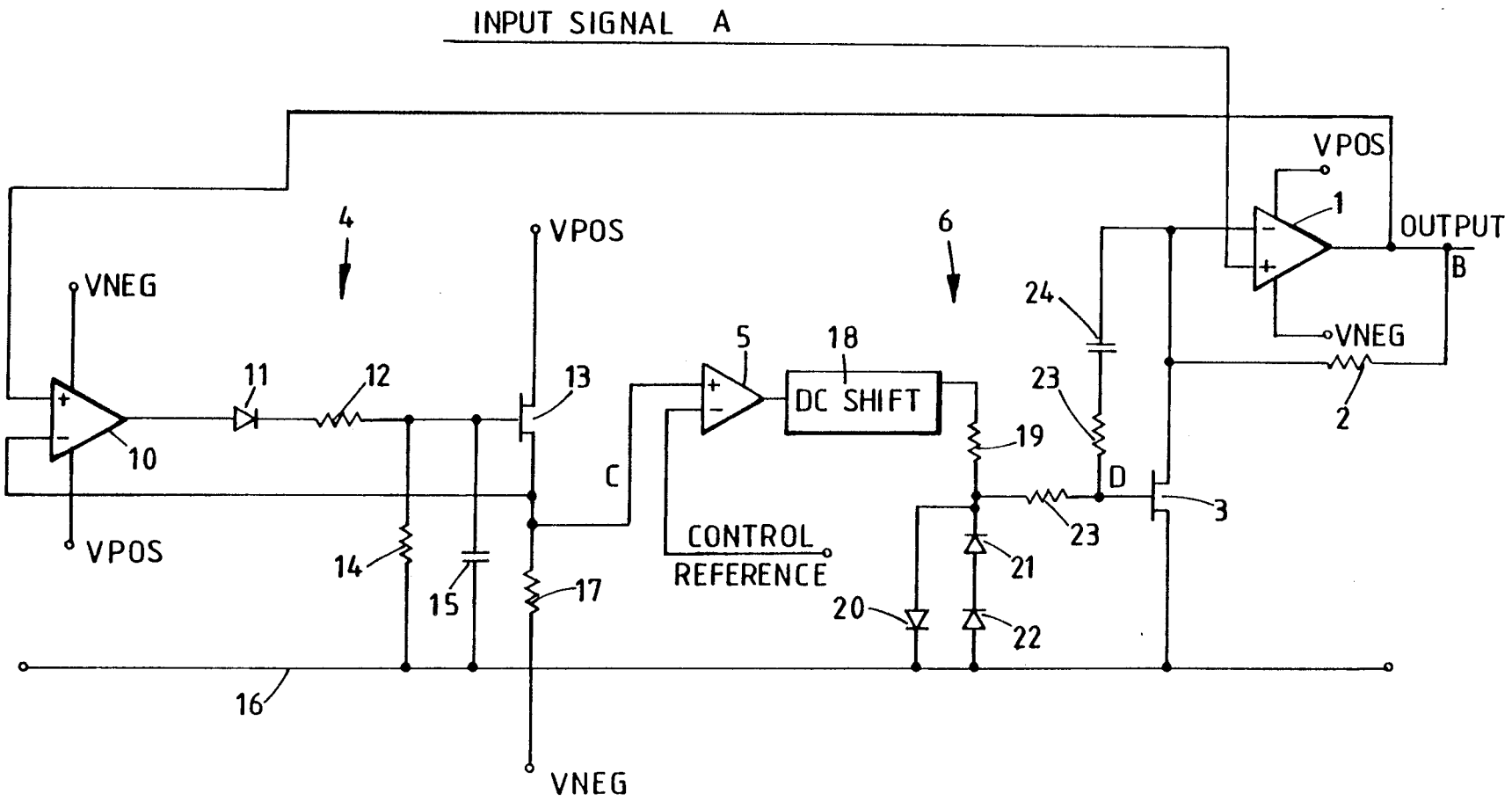
FIG. 2 is a circuit diagram of the processing circuit of FIG. 1.

As shown in FIG. 2, the peak hold circuit 4 comprises an operational amplifier 10 whose power supply inputs are connected to positive and negative power supply lines VPOS and VNEG. The output of the amplifier 10 is connected to the anode of a diode 11 whose cathode is connected to a first terminal of a resistor 12. The second terminal of the resistor 12 is connected to the gate of a field effect transistor 13 and to first terminals of a resistor 14 and a capacitor 15. The second terminals of the resistor 14 and the capacitor 15 are connected to a common line 16. The field effect transistor 13 is connected as a source follower with a resistor 17 providing a source load. The source of the field effect transistor 13 is connected to the inverting input of the amplifier 10, whose non-inverting input receives the normalised output signal from the output of the amplifier 1.

The source of the field effect transistor 13 is connected to the non-inverting input of the differencing amplifier 5 whose inverting input receives the control reference. The output of the amplifier 5 is connected to a DC shift circuit 18 whose output is connected to a clamp circuit comprising a resistor 19 and diodes 20 to 22. The output of the clamp circuit is connected via resistor 23 to the gate of the field effect transistor 3. A phase lead circuit comprising a capacitor 24 and a resistor 23 in series is connected between the gate of the field effect transistor 3 and the inverting input of the operational amplifier 1. The phase lead circuit is provided to increase the speed of response of the amplifier 1.

The circuit shown in FIGS. 1 and 2 operates as follows. The input signal (Graph A in FIGS. 3 and 4) comprises a sequence of pulses whose peak amplitudes vary. These pulses are amplified by the amplifier 1 with a gain which is dependent on the channel resistance of the field effect transistor 3. The normalised output signals (Graph B in FIGS. 3 and 4) are supplied to the peak hold circuit 4 and charge the capacitor 15 via the diode 11 and resistor 12. The values of the resistor 12 and the capacitor 15 are chosen so as to provide sufficiently rapid charging of the capacitor 15 such that the output of the peak hold circuit (Graph C in FIGS. 3 and 4) follows the peaks of the normalised output signal substantially instantaneously. The decay time constant of the resistor 14 and the capacitor 15 is chosen such that the peak level decays to 95% of its initial value during the maximum expected period between consecutive pulses of the input signal, for instance corresponding to idling speed of an internal combustion engine. The source follower formed by the field effect transistor 13 has an input impedance effectively in parallel with the capacitor 15 which is at least an order to magnitude greater than the value of the resistor 14, so that the capacitor 15 discharges principally through the resistor 14.

The differencing amplifier 5 forms the difference between the output of the peak hold circuit 4 and the control reference. This difference signal is DC shifted and clamped and supplied as the gain control signal (Graph D in FIG. 3) to the field effect transistor 3.

Figure 3:
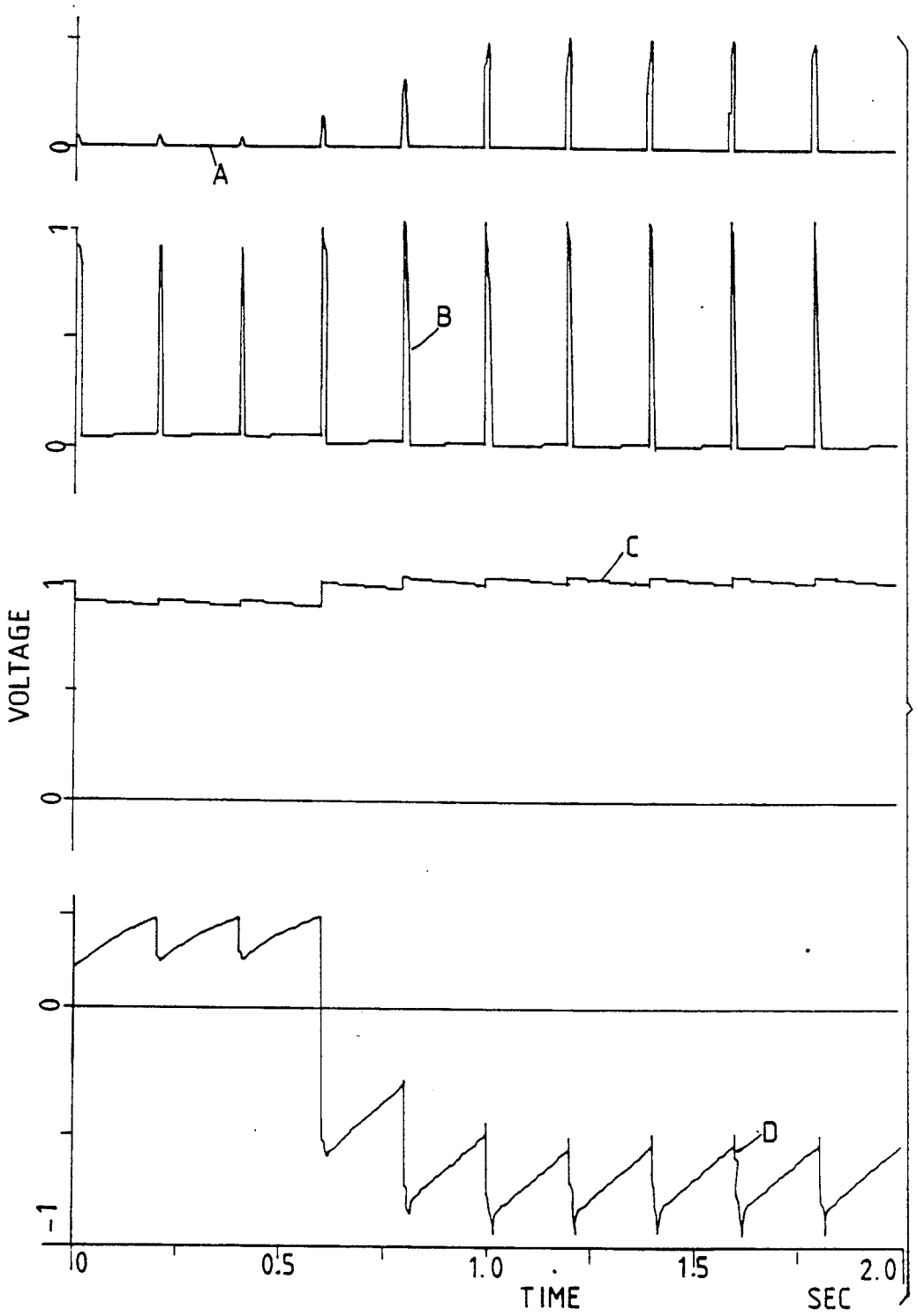
FIGS. 3 and 4 show various waveforms occurring in the circuit of FIG. 2.

As illustrated in FIG. 3, the effect of the circuit shown in FIG. 2 is to provide an automatic gain control function such that the peak amplitude of the output signal B is held substantially constant despite variations in the peak amplitude of the input signal pulses A. As the peak amplitude of the input signal pulses rises, the average level of the gain controlling signal D falls so that the gain of the variable gain amplifier is reduced.

Figure 4:
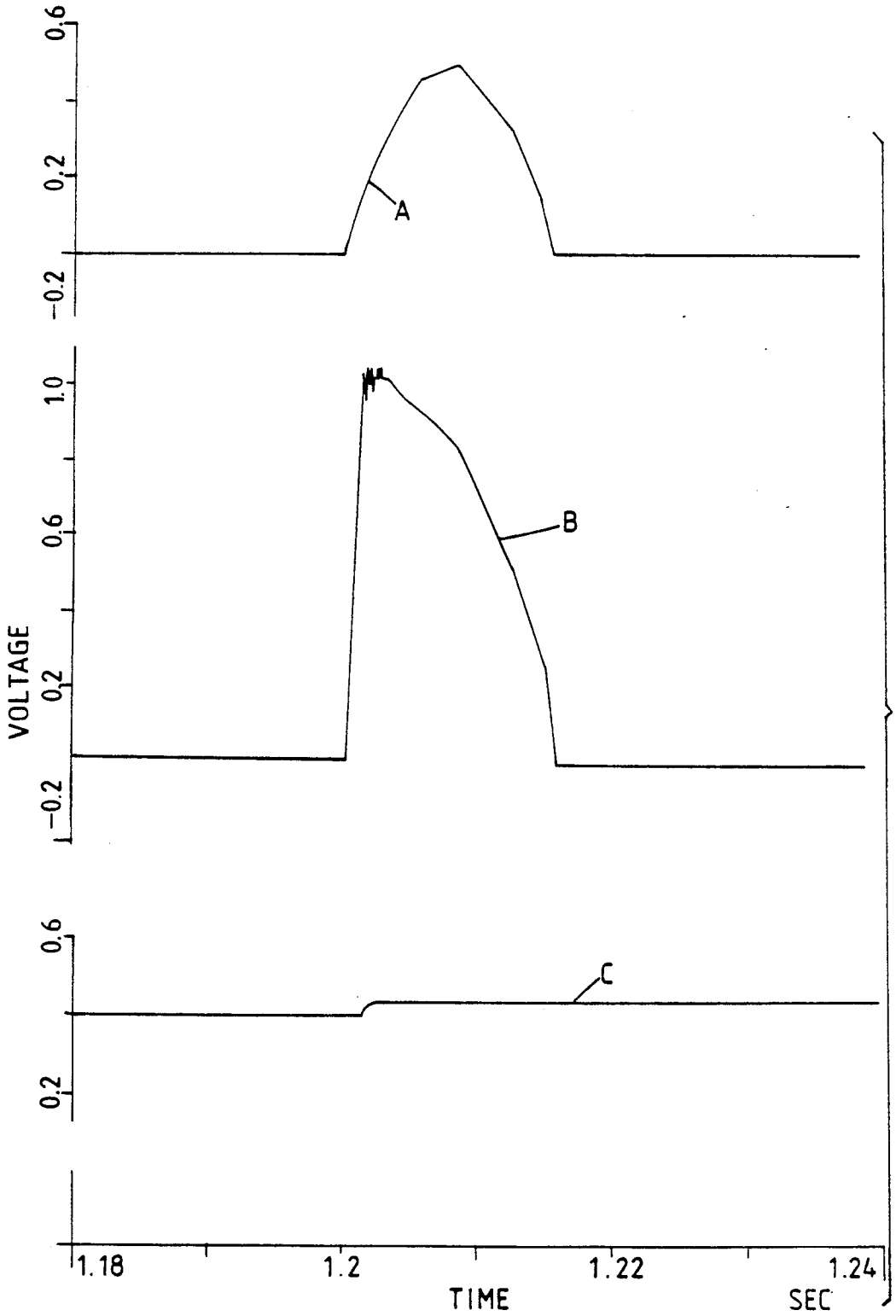

FIG. 4 shows part of the graphs A, B, and C of FIG. 3 with a greatly expanded horizontal time axis. Because the peak hold circuit 4 responds substantially instantaneously to each new peak, the gain of the variable gain amplifier varies during each input signal pulse. This causes harmonic distortion such that the output signal has a fast rise time as well as a normalised or substantially constant peak amplitude. It is thus possible to detect reliably the start of combustion in a cylinder of an internal combustion engine to which the optical sensor (not shown) is applied, despite large variations in the amplitude of the transducer signal. Thus, the processing circuit could be applied to either or both of the optical transducers in the arrangement disclosed in EP 0 282 295. Otherwise, the arrangement in EP 0 282 295 need not be altered. However, the processing circuit can also be used in order to detect the start of combustion by supplying the normalised output signal to a comparator having a fixed reference level. This is made possible by the fast rising edges and constant peak amplitude of the normalised output signal B.

We claim:

1. A processing circuit for an optical combustion monitor, comprising a variable gain circuit having an input for connection to an optical transducer to receive an input signal, an output for providing an output signal having a peak amplitude, and a controllable variable gain; and gain controlling means connected to said output of said variable gain circuit for controlling the controllable variable gain of said variable gain circuit so as to maintain substantially constant the peak amplitude of the output signal.

2. A circuit as claimed in claim 1, in which said gain controlling means includes a peak detector having an input connected to said output of said variable gain circuit and an output providing a detected signal.

3. A circuit as claimed in claim 2, in which said gain controlling means further includes a differencing circuit having a first input connected to said output of said peak detector and a second input for receiving a reference value.

4. A circuit as claimed in claim 1, in which said variable gain circuit comprises an amplifier and a negative feedback circuit, said negative feedback circuit including a voltage dependent resistor.

5. A circuit as claimed in claim 4, in which said voltage dependent resistor comprises a field effect transistor.

* * * * *